US008529648B2

(12) United States Patent
Kohl

(10) Patent No.: US 8,529,648 B2
(45) Date of Patent: Sep. 10, 2013

(54) MIXING AND FEEDING AQUEOUS SOLUTION OF ALKALI METAL SALT AND PARTICLES OF SULFUR-CONTAINING CARBONACEOUS FUEL FOR GASIFICATION

(76) Inventor: Arthur L. Kohl, Woodland Hills, CA (US)

( * ) Notice: Subject to any disclaimer, the term of this patent is extended or adjusted under 35 U.S.C. 154(b) by 643 days.

(21) Appl. No.: 12/520,014

(22) PCT Filed: Dec. 19, 2007

(86) PCT No.: PCT/US2007/088154

§ 371 (c)(1),
(2), (4) Date: Jun. 18, 2009

(87) PCT Pub. No.: WO2008/077107

PCT Pub. Date: Jun. 26, 2008

(65) Prior Publication Data

US 2010/0088958 A1 Apr. 15, 2010

Related U.S. Application Data

(63) Continuation-in-part of application No. 11/641,088, filed on Dec. 19, 2006, now abandoned.

(51) Int. Cl.

| | |
|---|---|
| ***C01B 3/36*** | (2006.01) |
| ***C01B 6/24*** | (2006.01) |
| ***C10J 3/16*** | (2006.01) |
| ***C10J 3/00*** | (2006.01) |

(52) U.S. Cl.
USPC ..... 48/202; 48/197 R; 48/210; 423/644

(58) Field of Classification Search
USPC ..... 48/197 R
See application file for complete search history.

(56) References Cited

U.S. PATENT DOCUMENTS

| | | | |
|---|---|---|---|
| 1,533,773 | A | 4/1925 | Sperr et al. |
| 2,094,070 | A | 9/1937 | Hultman |
| 2,242,323 | A | 5/1941 | Powell |

(Continued)

FOREIGN PATENT DOCUMENTS

| | | |
|---|---|---|
| GB | 1372039 | 10/1974 |
| WO | WO-80/02151 | 10/1980 |

OTHER PUBLICATIONS

Chai et al., "Determination of the solubility of inorganic salts by headspacegas chromatography", *J. Chromatography A*, 996:557-61 (2003).

(Continued)

*Primary Examiner* — Matthew Merkling
(74) *Attorney, Agent, or Firm* — Nasser Ashgriz

(57) ABSTRACT

A process of producing a combustible gas from a solid sulfur-containing carbonaceous fuel is provided. In the process, an aqueous solution is provided. A solute of the solution is a carbonate salt of an alkali metal. Particles of the fuel and the aqueous solution are mixed (26) to form a mixture. The mixture is fed into a gasifier (22) that contains molten salts of the alkali metal. The fuel is partially combusted in the gasifier to produce the combustible gas. At least a portion of the carbonate salt in the aqueous solution may be recovered (24) from a molten sulfide salt. The molten sulfide salt may be taken from the molten salts in the gasifier (22).

13 Claims, 2 Drawing Sheets

(56) References Cited

U.S. PATENT DOCUMENTS

| | | | |
|---|---|---|---|
| 2,675,297 | A | 4/1954 | Gray et al. |
| 2,830,883 | A | 4/1958 | Du Bois Eastman |
| 3,252,773 | A | 5/1966 | Solomon et al. |
| 3,710,737 | A | 1/1973 | Birk |
| 3,770,399 | A | 11/1973 | Chong |
| 3,916,617 | A | 11/1975 | McKenzie et al. |
| 4,017,271 | A | 4/1977 | Barclay et al. |
| 4,083,930 | A | 4/1978 | Kohl et al. |
| 4,153,670 | A | 5/1979 | Rennick |
| 4,423,702 | A | 1/1984 | Ashworth et al. |
| 4,441,959 | A | 4/1984 | Empie, Jr. |
| 4,682,985 | A | 7/1987 | Kohl |
| 4,773,918 | A | 9/1988 | Kohl |
| 4,807,542 | A | 2/1989 | Dykema |
| 5,435,940 | A | 7/1995 | Doering et al. |
| 5,458,659 | A | 10/1995 | Ashworth |
| 5,984,987 | A | 11/1999 | Kohl |
| 2001/0011438 | A1* | 8/2001 | Fujimura et al. ..... 48/197 R |
| 2003/0056438 | A1 | 3/2003 | Garnier et al. |
| 2006/0165582 | A1 | 7/2006 | Brooker et al. |

OTHER PUBLICATIONS

Elvers et al., "Paper and Pulp", *Ullmann's Encyclopedia of Industrial Chemistry*, vol. A18, 557-61 and 579-80 (1991).

Kohl et al., "Process upgrades coke to gas", *Hydrocarbon Processing*, 62:97-100 (1983).

Merkling, Matthew J., USPTO Office Communication dated Jan. 22, 2010 in relation to U.S. Appl. No. 11/641,088, filed Dec. 19, 2006 in the name of Arthur L. Kohl (14 pages).

* cited by examiner

MIXING AND FEEDING AQUEOUS SOLUTION OF ALKALI METAL SALT AND PARTICLES OF SULFUR-CONTAINING CARBONACEOUS FUEL FOR GASIFICATION

CROSS-REFERENCE TO RELATED APPLICATION

This is a continuation-in-part of U.S. application Ser. No. 11/641,088 filed Dec. 19, 2006, and claims the benefit of the prior U.S. patent application, the entire contents of which are incorporated herein by reference.

FIELD OF THE INVENTION

The present invention relates to gasification of solid sulfur-containing carbonaceous fuels.

BACKGROUND OF THE INVENTION

In a molten salt gasification process for producing a combustible gas from a solid sulfur-containing carbonaceous fuel, the fuel is partially oxidized with oxygen in a gasifier in the presence of molten alkali metal salts. The fuel can be coal, petroleum coke or another solid combustible material that contains sulfur and carbon. The products of the gasification reaction include the combustible gases, such as CO and $H_2$, and sulfur or sulfur containing material. The molten salts may include alkali metal carbonate, which acts as a catalyst for the gasification reaction and absorbs sulfur to form molten sulfur salt, thus reducing sulfur content in the gas product.

In a known technique, the fuel and carbonate salt are added to the gasifier in solid form. Such a technique has some drawbacks. For example, when the pressure in the gasifier is high, feeding solid fuel and salt into the gasifier is difficult and requires substantial equipment and operational cost. If the pressure in the gasifier is lowered, a larger gasifier is required to maintain the same production rate. Further, sticking and plugging can occur in the solid feed lines, particularly when water vapor is present.

It is thus desirable to provide an improved molten salt process for producing combustible gases from sulfur-containing carbonaceous fuels.

SUMMARY OF THE INVENTION

In accordance with an aspect of the present invention, there is provided a process of producing a combustible gas from a solid sulfur-containing carbonaceous fuel, comprising providing an aqueous solution, a solute thereof being a carbonate salt of an alkali metal; mixing particles of the solid sulfur-containing carbonaceous fuel and the aqueous solution to form a mixture; feeding the mixture into a gasifier that contains molten salts of the alkali metal; partially combusting the fuel in the gasifier, thus producing the combustible gas.

At least a portion of the carbonate salt in the aqueous solution may be recovered from a molten sulfide salt of the alkali metal. The molten sulfide salt of the alkali metal may be taken from the molten salts in the gasifier. The process may comprise removing a smelt of the molten salts from the gasifier; quenching the smelt with an aqueous medium, to form an aqueous liquid; contacting the aqueous liquid with a carbon dioxide gas, depressurizing and heating the aqueous liquid, and stripping hydrogen sulfur from the aqueous liquid, to form the aqueous solution comprising the solute of carbonate salt. An ash component may be removed from the aqueous solution. At least a portion of the carbon dioxide gas may be produced in the gasifier.

The mixture may be a slurry comprising particles of the fuel suspended in the aqueous solution. The mixture may be sprayed into the gasifier. The mixture may comprise about 25 to about 75 wt % of the fuel. The mixture may be fed to the gasifier using a slurry pump. The mixture may be at a temperature below about 200° C. prior to entering the gasifier.

The alkali metal may comprise one or both of sodium and potassium. The fuel may be petroleum coke. The gasifier may comprise a plurality of gasifiers. The aqueous solution may comprise about 5 to about 50 wt % of the carbonate salt. The combustible gas may comprise carbon monoxide and hydrogen.

The gasifier may have an internal gas pressure higher than about 4 atm. At least a portion of the molten salts may form a smelt bath in the gasifier, the smelt bath being at a temperature from about 760 to about 1,200° C.

An oxidant gas may be fed into the gasifier. The combustion may occur in a combustion region. The oxidant gas may be fed into the gasifier below or above the combustion region. The combustion region is at a temperature from about 900 to about 1,400° C. The oxidant gas may be selected from air, oxygen-enriched air, and substantially pure oxygen. Steam may be fed into the gasifier.

A product gas may be removed from the gasifier and purified. The purified product gas may be substantially free of sulfur and may have a high heating value higher than about 100 Btu/scf on a dry basis.

Other aspects and features of the present invention will become apparent to those of ordinary skill in the art upon review of the following description of specific embodiments of the invention in conjunction with the accompanying figures.

BRIEF DESCRIPTION OF THE DRAWINGS

In the figures, which illustrate, by way of example only, embodiments of the present invention.

DETAILED DESCRIPTION

Figure 1:
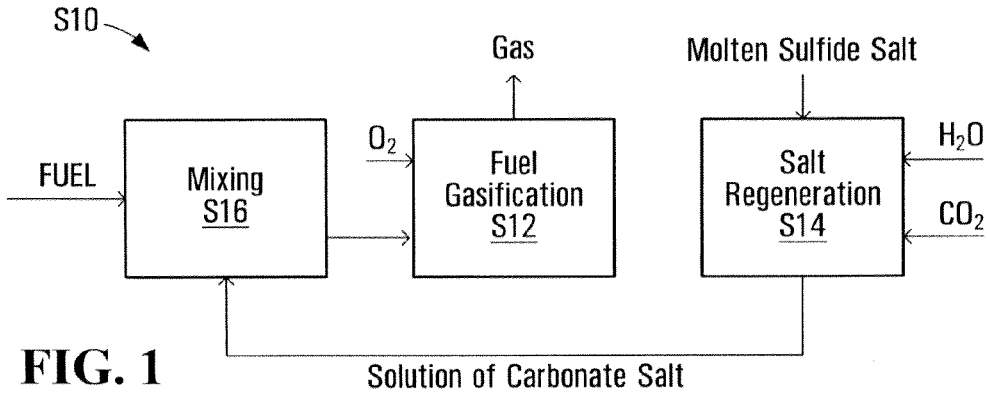
FIG. 1 is a block diagram for a gasification process, exemplary of an embodiment of the present invention.

In overview, an exemplary embodiment of the present invention is related to a process of producing a combustible gas from a solid sulfur-containing carbonaceous fuel in a gasifier that contains molten salts of an alkali metal. Particles of the fuel are first mixed with a separately provided aqueous solution to form an aqueous mixture. A solute in the aqueous solution is a carbonate salt of the alkali metal. The aqueous mixture is then fed into the gasifier. The sulfur-containing carbonaceous fuel is partially combusted in the gasifier to produce the combustible gas. Conveniently, the heat generated during the combustion reaction can provide the heat required to maintain the alkali metal salts in a molten state. The pressure in the gasifier may be higher than about 4 atm. Prior to entering the gasifier, the aqueous mixture may be at a temperature below about 200° C., such as from an ambient temperature to about 200° C.

The molten salts act as a catalyst for the gasification reactions and absorb sulfur to form sulfide salt. Sulfide salt may be recovered from the gasifier and carbonated. The regenerated carbonate salt can then be fed back to the aqueous solution.

Mixing as used herein refers to combining two or more initially separate materials by adding one to another. Mixing the fuel particles and the aqueous solution may include adding the fuel particles to the aqueous solution or adding the aqueous solution to the particles, and may include agitating the resulting mixture to disperse the fuel particles in the aqueous solution. The resulting mixture may be a slurry.

The fuel may be any combustible material that contains carbon and sulfur elements. Suitable fuel includes coals such as anthracite, bituminous or lignite coals; various types of petroleum coke; organic waste; photographic films; wood chips, or other solid fuel materials. The raw input for the fuel may be in solid or in semisolid forms and may be in the form of particles.

A combustible gas is any gas or mixture of gases that, when oxidized, can generate a sufficient amount of heat to sustain combustion reactions or to provide useful heat for a downstream process. The combustible gas may include carbon monoxide, hydrogen, and hydrocarbons. The final product gas that contains the combustible gas may have a low content of sulfur and other pollutants. In some embodiments, the product gas may be substantially free of sulfur and other pollutants. The product gas may contain non-combustible gases, such as $N_2$ and $CO_2$. However, when the volume ratio of combustible gas to non-combustible gas in the final product gas is high, more efficient combustion or heating may be achievable. For example, in some applications, the volume ratio of CO to $CO_2$ in the product gas may be substantially higher than 1, such as higher than 5.

The aqueous solution includes water as a solvent and the carbonate salt of the alkali metal as a solute.

The solute in the aqueous solution may be formed in any suitable manner. The solute may include recovered salts of the alkali metal. The solute may also include non-recovered salts of the alkali metal. The alkali metal may be sodium or potassium, or a combination thereof. In some embodiments, other alkali metals such as lithium, cesium, or the like may be used. The aqueous solution may include other salts of the alkali metal, such as sulfide, sulfite, sulfate, bi-sulfite, bicarbonate, thiosulfate, or the like. In some embodiments, the alkali metal carbonate content in the solution may be from about 5 to about 50 wt % (percentage by weight on the basis of total solution weight), such as about 10 to about 35 wt %. The carbonate concentration in the solution may vary depending on the type of fuel and on the solution temperature.

The aqueous solution of alkali metal carbonate may contain other ingredients or impurities, either dissolved or suspended, as discussed below.

Particles of the fuel are mixed with the solution of alkali metal carbonate prior to being fed into the gasifier. The particles of the fuel may be dispersed or suspended in the solution of alkali metal carbonate in any suitable manner. For example, the particle sizes of the fuel particles should be sufficiently small so that the aqueous mixture containing the fuel particles are suitable for being pumped with a selected pump and being fed through a selected feeding or spraying device as further described below. For instance, in some embodiments, the particle sizes may be such that a majority portion of the particles can pass through a 4 or 8 mesh filter depending on the application. The suitable upper limit for the average particle size may vary depending on the selected pump and feeding device in different embodiments. The particle sizes may also be selected so that the mixture, when fed into the gasifier, can form droplets that have substantially uniform droplet sizes within a selected range (further discussed below).

Conveniently, it is relatively easy to feed an aqueous mixture of the fuel and the carbonate salt, such as in a slurry form, to the gasifier even when the gasifier is pressurized to a high pressure, as compared to feeding solids of the fuel and carbonate salt to a pressurized gasifier. Pre-mixing the fuel and the carbonate salt can also facilitate the desired reactions in the gasifier as the fuel particles and the carbonate salt are close to or in contact with each other and can be dispersed relatively uniformly over the combustion region in the gasifier. Feeding a low temperature solution of a solute of alkali metal salt also does not require the costly equipment, energy resources and maintenance that are required for feeding a molten carbonate salt. For example, a molten carbonate salt needs to be kept under a sufficiently high temperature to remain in a liquid state. In comparison, an aqueous solution of alkali metal carbonate can be transported into the gasifier at a relatively low temperature, such as at an ambient temperature. Another consequence of reduced temperature is that corrosion by alkali metal salts can be significantly reduced. Thus, equipment, operation and maintenance costs may be reduced when the carbonate salt is transported and fed into the gasifier in a low temperature solution.

An exemplary embodiment of the present invention is schematically illustrated in FIG. 1. Process S10 is a gasification process in which combustible gases such as CO and $H_2$ are produced from a sulfur-containing carbonaceous fuel.

The input for the gasification stage S12 includes a mixture of the fuel and a solution of carbonate salt and an oxidant such as oxygen. Combustion reactions involving the fuel and the oxidant take place at S12. The oxidant may be supplied in the form of air, oxygen-enriched air, pure or substantially pure oxygen, oxygen combined with steam, or other suitable forms. The oxidant may be supplied in any suitable manner, such as in manners described below. In the present example, the principal chemical reaction for the gasification and combustion process that occurs at gasification stage S12 is:

$$C+\tfrac{1}{2}O_2=CO. \quad (1)$$

To increase the yield of CO in the final product gas, the oxygen supply may be limited to a level such that the fuel is only partially combusted. Partial combustion as used herein does not mean that only a portion of the fuel material is combusted. Rather, partial combustion refers to the partial oxidation of carbon. That is, a substantial amount of CO is present in the product gas. For example, in some embodiments, the volume ratio of CO to $CO_2$ in the product gas is greater than 5:1. In some embodiments, it may even be desirable that as much as possible of the carbon content in the fuel be partially oxidized to CO. In some embodiments, the amount of free oxygen provided to the gasification stage S12 is less than about 60 percent of the amount of oxygen stoichiometrically required for complete oxidation or combustion.

As the fuel may contain various other substances and since water is present, other chemical reactions may also occur during gasification at S12 and may produce other products such as $CO_2$, $H_2$, $H_2O$, $H_2S$, $CH_4$, or the like. For example, other additional reactions may include:

$$C+H_2O=CO+H_2, \text{ and} \quad (2)$$

$$CO+H_2O=CO_2+H_2. \quad (3)$$

Because the combustion reactions are exothermic, a net heat is generated at S12.

The combustion reactions may be carried out in a gasifier, such as those shown in FIGS. 2, 3, and 4 (further described below).

The combustion reactions are carried out in the presence of molten salts of one or more alkali metals. The alkali metal is represented herein by the symbol "M". The salts typically include carbonate salt ($M_2CO_3$), sulfide salt ($M_2S$) and sulfate salt ($M_2SO_4$). The presence of molten alkali metal carbonate in the combustion zone provides several convenient benefits. Alkali metal carbonate may serve as a catalyst for the combustion reactions such as reaction (1). Molten alkali metal carbonate also absorbs sulfur released from the fuel, and forms a molten sulfur salt of the alkali metal, such as a sulfide or sulfate salt, thus reducing the sulfur content in the gas products.

When sufficient carbon is present, formation of the sulfide salt is favored due to the following reactions that may occur at the fuel and the molten salt interface region:

$$4C+M_2SO_4=M_2S+4CO, \quad (4)$$

$$2C+M_2SO_4=M_2S+2CO_2. \quad (5)$$

These reactions promote carbon oxidation and limit re-oxidation of the sulfide.

As illustrated in FIG. 1, an aqueous solution is prepared at S14. The aqueous solution includes water as a solvent and carbonate salt as a solute, and optionally sulfide salt. The alkali metal carbonate solute may be recovered or regenerated from a molten sulfide salt at a salt regeneration stage S14, as depicted in FIG. 1. The molten sulfide salt may be quenched with water and then chemically converted to the carbonate salt solute. The principal or overall chemical reaction involved in the regeneration of carbonate salt may be:

$$M_2S+CO_2+H_2O=M_2CO_3+H_2S. \quad (6)$$

$CO_2$ may be provided in a number of suitable manners. For example, $CO_2$ may be absorbed from a dilute gas, injected as pure $CO_2$, or generated by decomposing $MHCO_3$ (see, e.g., the further description below).

Water may be supplied in any suitable manner, such as from an external source or from recycled water collected within the gasification and salt regeneration process (see, e.g., the further description below).

The aqueous solution is mixed with the fuel at S16, and is conveniently used as a carrier for feeding the fuel to the gasification stage S12. The input fuel for mixing at S16 may be in the form of solid or semisolid particles as described herein. The mixture formed at S16 may form a slurry.

Figure 2:
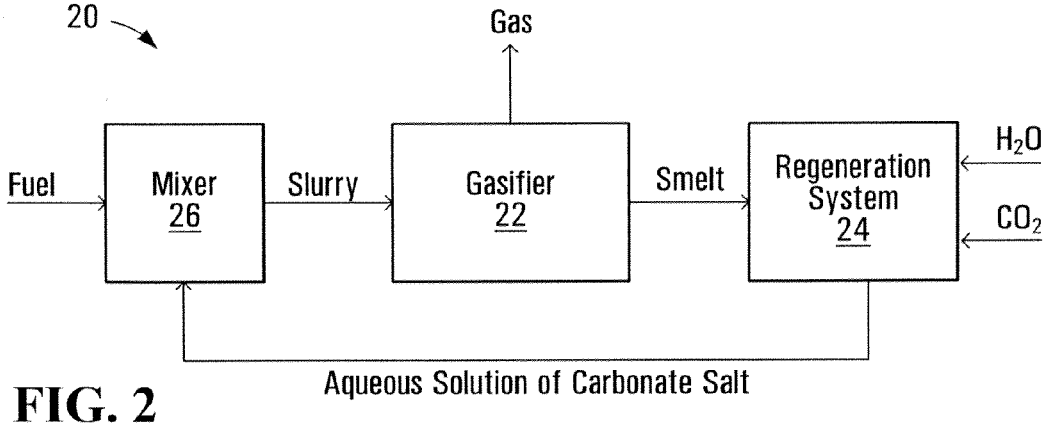
FIG. 2 is a block diagram of an exemplary gasification system suitable for use in the process of FIG. 1.

FIG. 2 schematically illustrates a gasification system 20, which may be suitable for carrying out process S10. In particular, system 20 includes a gasifier 22, which may be any gasifier that is suitable for gasification of a particular fuel to produce the desired reactants. The reaction conditions in gasifier 22 may be selected or optimized depending on the nature of the particular fuel used and the desired product in a given application. Gasifier 22 should be able to withstand the operating conditions in the particular process, such as elevated temperatures and pressures. As some of the materials contained in the gasifier may be highly corrosive under the operating conditions, gasifier 22 should also be corrosion-resistant. In some embodiments, existing gasifiers for similar gasification processes may be adapted for use in system 20. Exemplary suitable gasifiers are described in detail below.

System 20 also includes a regeneration system 24 for regenerating the solute of carbonate salt and a mixer 26 for mixing the fuel particles and the aqueous solution of carbonate salt into a slurry mixture to be provided to gasifier 22. The fuel and the aqueous solution are mixed in mixer 26 to form a slurry mixture. The slurry mixture is then fed to gasifier 22. The slurry mixture may contain particles of the fuel suspended in the aqueous solution of the salt. The particle sizes of the fuel in the slurry mixture may be selected and controlled so that the slurry mixture is suitable for being transported to and fed into gasifier 22 as described herein. The fuel may also be dispersed in other forms in the mixture as will be described below.

For simplicity, some details of, other input to and output from, gasifier 22 or regeneration system 24 are omitted in FIG. 2, as can be understood by those skilled in the art. For example, while not shown, it should be understood that an oxidant is supplied to gasifier 22 and gasifier 22 contains molten salts as described herein. The omitted features may also include optional features that may be provided in a particular application.

As shown in FIG. 2, the molten sulfide salt used to regenerate/recover the carbonate solute may be taken from gasifier 22. In one embodiment, a smelt of molten salts may be removed from gasifier 22 and quenched with an aqueous medium, to form an aqueous liquid. The aqueous liquid includes dissolved alkali metal sulfide. The aqueous liquid may then be contacted with a carbon dioxide gas, depressurized, heated, and stripped of hydrogen sulfide, to form an aqueous solution that contains a solute of carbonate salt converted from the sulfide salt. This aqueous solution is then used to convey the fuel to gasifier 22. At least a portion of the carbon dioxide gas may be produced in gasifier 22.

In a different embodiment, a smelt of molten alkali sulfide salt taken from a different gasifier, or another molten salt source, may be used to provide the carbonate solute to be fed to gasifier 22. For example, in an alternative, modular gasification system 30 as schematically shown in FIG. 3, smelts taken from two different gasifiers 32A and 32B may be combined to produce an aqueous solution in regeneration system 24, which is then fed to each of gasifier 32A, and 32B.

Figure 3:
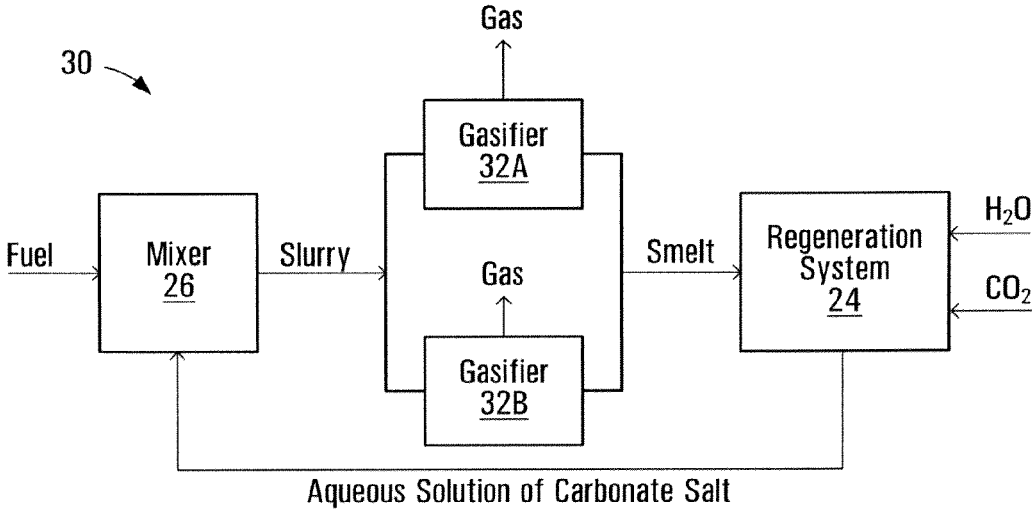
FIG. 3 is a block diagram of another exemplary gasification system suitable for use in the process of FIG. 1.

In another embodiment, the aqueous solution may be fed to only one of gasifiers 32A and 32B, or to a different gasifier not shown in FIG. 3.

In a further embodiment, the smelt taken from gasifier 32A may be used to regenerate/recover the carbonate solute to be fed to gasifier 32B.

As can be appreciated, in further alternative embodiments, more than two gasifiers may be used in similar manners as discussed herein. As can be appreciated, a modular gasification system that includes a plurality of gasifiers may be advantageous in some applications. For example, smaller, and less expensive gasifiers may be combined to achieve the same production rate, in place of a larger and more expensive gasifier. In a modular gasification system, it is also possible to maintain production while one or some of the gasifiers are turned down for maintenance or repair.

The regeneration of carbonate salt from the smelt containing molten sulfide salt may be performed in any suitable manner. For example, in one embodiment, the regeneration process described in U.S. Pat. No. 4,083,930 to Kohl et al. (referred to herein as "Kohl"), entitled "Method of treating alkali metal sulfide and carbonate mixtures" and issued Apr. 11, 1978, the entire contents of which are incorporated herein by reference, may be modified to regenerate/recover the carbonate solute. In particular, the calciner (82) of Kohl is not necessary for the present purpose, as calcination of the bicarbonate salt is not required. The bi-carbonate slurry (76) of Kohl may be heated to decompose bicarbonate crystals and dissolve the resulting carbonate, and the resulting aqueous solution may be recycled to the gasifier. An alternative regenerative process is described in U.S. Pat. No. 4,153,670 to Rennick (referred to herein as "Rennick"), entitled "Method of treating alkali metal sulfide liquor" and issued May 8, 1979, the entire contents of which are incorporated herein by reference. The method disclosed in Rennick may be adapted and modified to process the aqueous liquid formed by quenching the smelt with an aqueous medium (see below), to produce an aqueous carbonate solution for recycling to mixer 26. The method of Rennick may also be used to strip sulfide gas from the solution.

Figure 4:
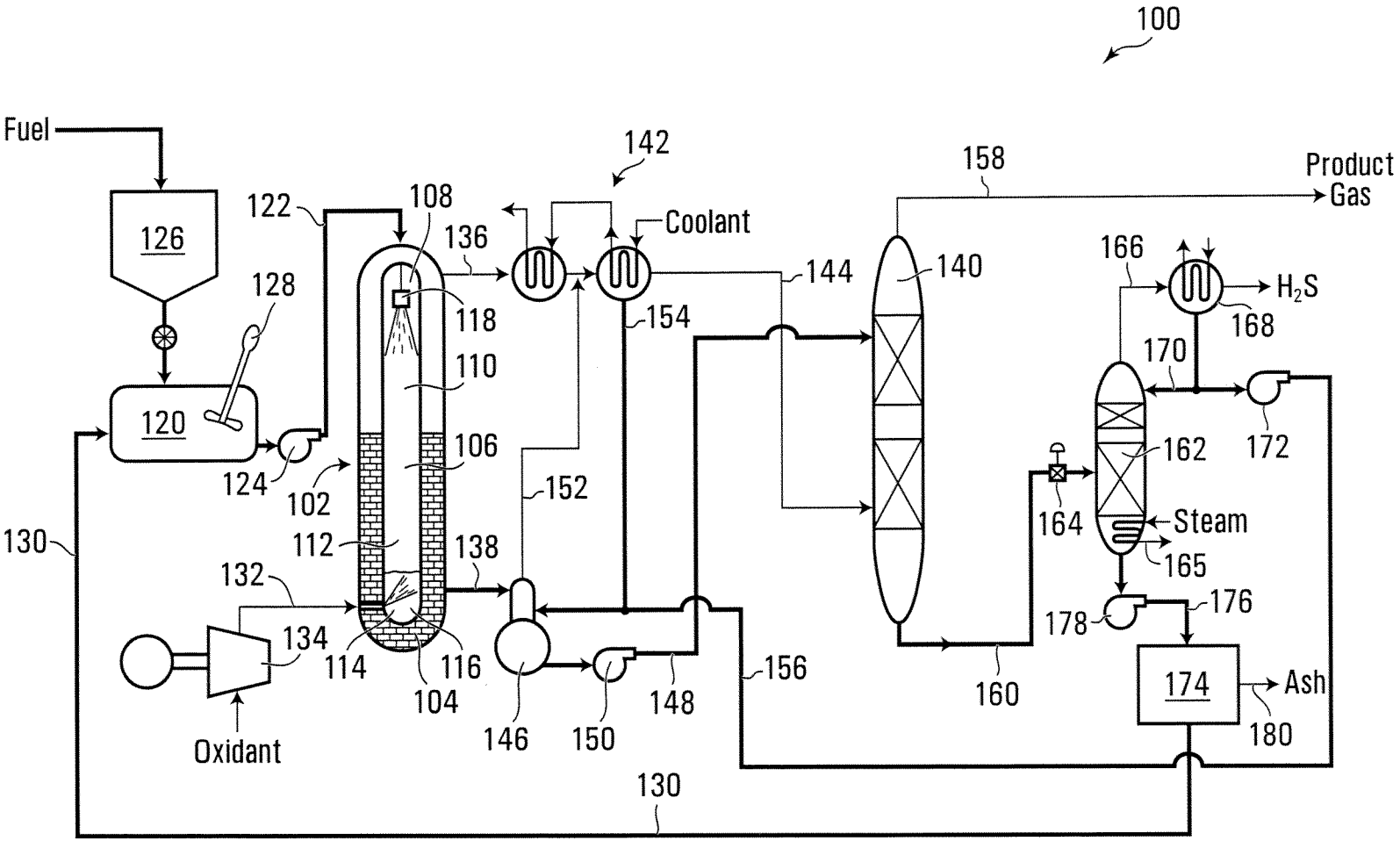
FIG. 4 is schematic diagram of a gasification system suitable for use in the process of FIG. 1.

FIG. 4 schematically illustrates a gasification system 100 suitable for use in process S10, exemplary of an embodiment of the present invention. System 100 may be suitable for production of combustible gases and for recovery of sulfur elements, and optionally, for recovery of vanadium and other by-products.

System 100 includes a gasifier 102, which has a wall 104 that defines a reaction chamber 106. The wall material may be any material that is suitable for a conventional gasifier. For example, the wall may contain a refractory material. The inner surface of wall 104 may be resistant to molten salt of alkali metals and other materials that may be present in gasifier 102. Wall 104 may also contain a layer of heat insulating materials. Wall 104 may also be strong enough to withstand high pressures. Gasifier 102 may be provided with a heating system (not shown) for initially raising the temperature in reaction chamber 106 and melting the salts at the gasifier start up.

The internal pressure in reaction chamber 106 may be kept at from about 4 to about 50 atm, such as from about 6 to about 40 atm. The pressure in reaction chamber 106 may be different in other embodiments. Thus, for some applications, the pressure may be higher than 50 atm. In some applications, the pressure may be as high as is safely allowed using available equipment. A high pressure may be desirable in some applications as the volume of reaction chamber 106 can be reduced at higher pressures for the same production rate of the combustible gas. Further, the sizes of gas conduits connected to gasifier 102, such as outlet 136 and conduit 144, and other downstream gas handling equipment may be reduced. A higher gas pressure also increases the efficiency of gas absorption operations, which may be performed in the system such as described herein, and permits the off-gas to be used directly in downstream equipment such as gas turbines or other devices, which require a pressurized feed gas. However, the pressure in gasifier 102 may be limited due to available technology and other considerations. For instance, the pressure may be limited due to available materials for constructing gasifier 102, and the particular structure of gasifier 102. The compression cost of slurry and oxidant(s) in addition to the construction costs of gasifier and gas handling system may play a role in selecting the operating pressure.

Reaction chamber 106 can be divided into different regions, a spray region 108, a drying region 110, a combustion region 112, and a smelt region 114. Some of these regions may overlap.

Smelt region 114 contains molten salts 116. Molten salts 116 contain alkali metal salts and other solid or liquid materials that may be present or produced in gasifier 102. Such other materials may include ash components, and particles of un-reacted fuel. Depending on the amount of molten salts accumulated in gasifier 102, molten salts 116 may form a smelt bath, or a thin layer. The depth of the smelt bath or the thickness of the molten salt layer may vary in different embodiments. For example, in some embodiments, it may be desirable to have a sufficiently deep smelt bath of the molten salts so that an oxidant gas, such as air, may be fed through the smelt bath and be sufficiently mixed with the molten salts before the air rises into the combustion region. On the other hand, in other applications, such as when the oxidant gas is supplied in the form of pure oxygen, it may not be necessary to feed pure oxygen through a smelt bath of molten salts. In such a case, the molten salts falling to the bottom of gasifier 102 may simply be drained out from gasifier 102. The thickness of the molten salt layer or the depth of the smelt bath may be adjusted by adjusting the position of outlet 138 and the flow rate of the smelt effluent.

A spraying device 118 is provided in spray region 108, which as shown may be positioned at a top region in reaction chamber 106. In other embodiments, a spraying device may be positioned elsewhere. For example, in some embodiments, a spraying device for feeding the slurry may be positioned on a side of gasifier 102. A plurality of spraying devices may be provided. The spraying devices may be positioned and directed so that the sprayed slurry streams from different spraying devices cover different areas to form an overall substantially uniform dispersion of the slurry. Alternatively, the spraying devices may be positioned and directed so that the different slurry streams will collide with one another. Generally, a spraying device should be positioned and directed so that the sprayed slurry droplets will eventually fall into and pass through combustion region 112.

Spraying device 108 may have one or more nozzles (not individually shown) suitable for spraying the slurry into drying region 110. Any suitable spraying device may be used. For example, the spraying device may include a pressure atomizer or gas-assisted atomizer for dispersing droplets of the slurry into gasifier 102. In some embodiments, spraying device 108 may be selected and positioned so that, the droplets of the slurry formed in gasifier 102 have a relatively narrow size distribution and are dispersed substantially uniformly into combustion region 112.

Spraying device 108 may also be selected so that the mean droplet size of the sprayed slurry is within a desirable range. The desired mean droplet size may vary in different embodiments and applications. For example, the permissible mean droplet size may be larger when the oxidant gas is fed into gasifier 102 below combustion region 112, as depicted in FIG. 2, but smaller when the oxidant gas is fed above combustion region 112, as will be further discussed below. In some embodiments, the mean droplet size of the slurry droplets may be on the order of millimeter such as from about 0.5 to about 5 mm, when the oxidant gas is fed from below combustion region 112, and may be less than 1 mm, such as about 0.2 mm when the oxidant gas is fed from above combustion region 112. The mean droplet size and droplet size distribution may be selected to improve efficiency, and may be determined depending on the particular application.

A slurry tank 120 for preparing a slurry to be fed to gasifier 102 is connected to gasifier 102 by a conduit 122.

A slurry pump 124 may be provided to drive the slurry through conduit 122. Pump 124 may be any suitable slurry pump and should be selected so that a sufficient pressure is produced to force the slurry into gasifier 102 through spraying device 118 at a desired mass flow rate. More than one pumps may be used in some embodiments. The slurry pump may be selected so that it is suitable for pumping high viscosity liquid and for use with highly corrosive materials such as alkali metal salts. In some embodiments, commercially available slurry pumps may be used. For example, a slurry pump, such as in the KZN series, provided by BJM Pumps™ may be suitable for some applications. Other commercial providers for potentially suitable slurry pumps include VerderFlex™, and Tuthill Corporation™, which provides for example the Tuthill HD series of pumps. In some applications, a commercially available pump may be adapted or modified to meet the particular demand in the particular application. In other embodiments, specially designed slurry pumps may be custom-made to meet the particular requirements in the particular application.

Slurry tank 120 contains a slurry formed of particles of the sulfur-containing carbonaceous fuel suspended in an aqueous solution containing a solute of carbonate salt of an alkali metal.

A feed hopper 126 is provided for feeding the solid fuel particles at a controlled rate into slurry tank 120. Feed hopper 126 may be fed with fuel particles of a proper particle size distribution. The particles of the fuel may be prepared with a separate device such as a grinder (not shown). The appropriate particle size distribution may be determined as described herein.

A mixing device 128 is provided for dispersing and mixing particles of the fuel in the aqueous solution in slurry tank 120. Mixing device 128 may be any suitable device for dispersing or mixing a solid in a liquid to produce a suspension or slurry. The mixing device may be selected so that it is suitable for use with corrosive materials such as alkali metal salts.

The aqueous solution containing the carbonate solute may be fed to slurry tank 120 through conduit 130, and may be regenerated from a smelt as described below.

A gas conduit 132 connects a compressor 134 to gasifier 102 for feeding an oxidant gas into reaction chamber 106. Conduit 132 may be connected to feed the oxidant gas into smelt region 114, so that the oxidant gas will pass through molten salts 116 before rising to combustion region 112 above smelt bath 116. The oxidant gas may be any suitable gas that contains a sufficient amount of free oxygen or can otherwise serve as a source of free oxygen. For example, in an exemplary embodiment, air may be used as the oxidant gas. In another embodiment, oxygen-enriched air or pure oxygen gas may be used as the oxidant gas. When pure oxygen is used, the nitrogen content in gasifier 102 may be substantially reduced.

Optionally, highly oxygen-enriched air or pure oxygen and steam may be separately injected into gasifier 102 as oxidant gases. Thus, an inlet (not shown) for steam input may be provided for injecting steam into gasifier 102.

Gasifier 102 has a gas outlet 136 for extracting gas products from reaction chamber 106. Outlet 136 may be positioned at a top portion of reaction chamber 106, as depicted in FIG. 4.

Gasifier 102 has smelt outlet 138, positioned at a lower portion of reaction chamber 106, for a smelt effluent to be removed from smelt region 114.

Gasifier 102 may be in flow communication with a gas purifier 140 through different conduit paths.

A first path from gasifier 102 to gas purifier 140 is for produced gases. This path, as depicted in FIG. 4, may include gas outlet 136, cooler-condenser 142 and gas conduit 144. Gas conduit 144 may be connected to a lower part of gas purifier 140. Cooler-condenser 142 may be any suitable gas condensing and cooling system and may include separate or integrated cooling and condensing units. Cooler-condenser 142 may utilize a coolant such as water to cool the hot gas products, including the vented gas via conduit 152, that are flowing through conduit 144. The coolant water in cooler-condenser 142 may be warm or hot and may become steam by heat absorbed from the hot gases.

A second path from gasifier 102 to gas purifier 140, as depicted in FIG. 4, may include smelt outlet 138, quench tank 146 for quenching the smelt effluent from reaction chamber 106, and conduit 148 that connects quench tank 146 and gas purifier 140. A liquid pump 150 may be provided for driving fluid through liquid conduit 148. Quench tank 146 is also connected with liquid conduit 156 for receiving a liquid input, as will be further described below. A portion of the hot off-gas generated in the gasifier 102 may also be allowed to flow through smelt outlet 138, over the flowing smelt effluent. The hot off-gas can provide heat for maintaining the temperature in smelt outlet 138 higher than 750° C. to prevent smelt solidification.

As depicted in FIG. 4, gas conduit 152 may be used to transfer product gas that entered the quench tank via smelt outlet 138 and vent gas released from quench tank 146 to gas purifier 140 through cooler-condenser 142 and conduit 144. Fluid conduit 154 may be used to transfer condensates produced in cooler-condenser 142, such as condensed water vapor, to quench tank 146.

Gas purifier 140 may be any suitable gas purifier and may include a suitable known purification system.

The gas purifier 140 depicted in FIG. 4 is a counter-current packed tower. The tower may have two packing zones, as depicted, which may contain Raschig rings. In the tower, a highly alkaline aqueous solution can absorb acid gases such as $H_2S$ and $CO_2$ from the gas passing upward through the packing. This serves to purify the gas and to decrease the alkalinity of the solution. Other suitable gas purifiers may also be used.

Gas purifier 140 has a gas outlet 158 for product gas.

Gas purifier 140 is connected, through liquid conduit 160, to a stripper 162 for stripping acid gases such as hydrogen sulfide and carbon dioxide from the output liquid of gas purifier 140. A pressure reduction valve 164 may be provided in conduit 160 so that a large fluid pressure differential may be established across the valve in the fluid flow. Stripper 162 also has a heater 165 for heating the contents in stripper 162. Heater 165 may be a coil heater using any suitable heating fluid, such as steam.

Stripper 162 has a gas outlet 166 for output gas. Gas outlet 166 may be cooled by a condenser 168. Condenser 168 may use cold water as the coolant. A liquid conduit 170 connects the outlet of condenser 168 to stripper 162 for circulating any condensates, such as condensed water, formed in condenser 168 back to stripper 162. A portion of condensed water flowing in conduit 170 may also be transferred to quench tank 146 through conduit 156.

Stripper 162 may be connected to an ash separator 174 through a conduit 176 for transferring the output liquid thereto. A pump 178 may be provided to drive fluid through conduit 176. Ash separator 174 can separate ash component from the liquid output from stripper 162 and has a discharge outlet 180 for disposing the separated ash component. Ash separator 174 may be connected to slurry tank 120 through conduit 130 for feeding the aqueous component from the liquid output from stripper 162 to slurry tank 120.

For simplicity, some necessary or optional components of system 100 are omitted in FIG. 4. The omitted components should be apparent to or can be determined by those skilled in the art. Such components include, for example, fluid flow control and regulating devices, such as valves, meters, coolers or heaters for adjusting the temperatures of process fluids, and other operating or control components. In addition, equipments such as conduits or feeding devices for adding makeup water and makeup alkali metal carbonate to the process may be provided but are not shown.

In use, gasification system 100 may be operated as follows.

A solid fuel, such as petroleum coke powder or fine particles, is fed to hopper 126 and then under a controlled rate, the fuel particles are fed into slurry tank 120. The particles sizes of the fuel in slurry tank 120 may be selected as described herein, and depending on factors such as the size of gasifier 102, the desired flow rate, the particular type of spraying device 118, and other factors.

An aqueous solution containing a solute of alkali metal carbonate is also fed to slurry tank 120. For the purpose of illustration and ease of description, it is assumed below that the carbonate solute is sodium carbonate. It should be understood that other carbonate salts may also be used, and sodium may be replaced with another alkali metal such as potassium. At least a portion of the sodium carbonate in the solution may be recovered from molten sodium sulfide taken from smelt region 114 of gasifier 102, as described below.

The aqueous solution fed into slurry tank 120 may contain about 5 to about 50 wt %, such as about 10 to about 35 wt %, of alkali metal carbonate. The aqueous solution may also contain alkali metal sulfide, and small amounts of other salts such as alkali metal bicarbonate, bisulfide, thiosulfate, and sulfate.

The fuel is dispersed in and mixed with the aqueous solution contained in slurry tank 120 using mixing device 128. After mixing, the particles of petroleum coke may be suspended in the aqueous solution, thus forming a slurry. The solution and the fuel may be added in a controlled manner so that the slurry input to gasifier 102 contains about 25 to about 75 wt %, such as about 35 to about 65 wt %, of suspended particles of the fuel.

The slurry is fed, such as being pumped using slurry pump 124, into gasifier 102 through conduit 122 at a desired steady flow rate.

The input slurry is then sprayed into drying region 110 using spraying device 118. The slurry may be sprayed into droplets as described herein.

The slurry droplets are rapidly heated by contacting with the hot product gas in the drying region 110 and by radiant heat emitted from combustion region 112. Therefore, water in the slurry is quickly vaporized; the dried sodium carbonate initially forms a thin layer of solid sodium carbonate particles on the solid fuel particles. The sodium carbonate, and any other salt present, will later become melted due to further heating as the particles continue to fall. The fuel particles, which are falling with the salts, may thus be coated with a layer of molten sodium salts.

The particles of the fuel and sodium carbonate then fall into combustion region 112 and react with the oxidant present in combustion region 112. The combustion region may include molten salts 116, which may form a smelt bath as depicted in FIG. 2, or a region where molten salts are separated from the gas.

A stream of an oxidant gas may be fed into gasifier 102 through conduit 132 by compressor 134. The oxidant gas may be air, oxygen-enriched air, pure oxygen, and oxygen and steam. The compressor 134 may compress the oxidant gas to a pressure slightly higher than the pressure in reaction chamber 106 as required to maintain a desired flow rate. A portion of oxidant gas may be injected into smelt region 114 from where it rises up through molten salts 116 into combustion region 112. The oxidant gas is heated as it goes through combustion region 112. The oxidant gas may be fed at a rate such that the free oxygen in reaction chamber 106 is insufficient for complete oxidization of the carbon in the fuel. Assuming the concentration of free oxygen required for complete combustion is represented by $[O]_c$, the amount of free oxygen fed to the gasifier 102 is less than about 60% of $[O]_c$. The feeding rate of the oxidant gas in a particular application may be selected taking into consideration various factors. For example, when an excessive amount of air is fed to reaction chamber 106, it may promote the combustion reactions to an extent such that the temperature in combustion region 112 rises above the desired temperature range. Another consequence of excessive air and hence more complete combustion is that the high heating value of the product gas would be reduced, as more CO would be converted to $CO_2$. However, if insufficient air is fed to reaction chamber 106, too many fuel particles would not be gasified and excessive un-reacted fuel particles would build up in reaction chamber 106 and drain out into quench tank 146. A person skilled in the art can readily determine a suitable feeding rate of the oxidant gas for a given application. For example, suitable feeding rates may be determined in view of the test and calculation results disclosed in A. L. Kohl and J. A. Ashworth, "Process Upgrades Coke to Gas," Hydrocarbon Processing, 1983, vol. 62, pp. 97-100 (referred to herein as "Kohl and Ashworth"), the entire contents of which are incorporated herein by reference.

For instance, in some embodiments where the oxidant gas is air, free oxygen content fed to gasifier 102 may be kept at about 35 to about 50% of $[O]_c$. At such a rate of air feeding, the temperature in combustion region 112 may be maintained at from about 900 to about 1,400° C., such as from about 950 to about 1,300° C.

When an inlet for steam is provided, a stream of steam may be injected into combustion region 112 to moderate the temperature in combustion region 112 and to provide hydrogen-rich product gas (e.g. through reactions 2 and 3). In some applications, $O_2$ and steam may be used as oxidants. In these embodiments, the volumetric concentration of hydrogen in the product gas may range from 30 to about 40 v/v %. The suitable feeding rate of the steam may vary and may be determined by those skilled in the art in a given application. For example, the feeding rate of steam or the input ratio of fuel to steam may be selected in view of the results disclosed in Kohl and Ashworth.

In combustion region 112, the carbon content in petroleum coke and the free oxygen reacts according to the combustion reaction (1). Other chemical and combustion reactions may also occur. As the combustion reaction (1) is exothermic, the released heat keeps the temperature of reaction chamber 106 at elevated levels.

Conveniently, the molten sodium carbonate in reaction chamber 106 catalyzes the combustion reaction and absorbs the sulfur released during the combustion reaction. Sulfur reacts with sodium carbonate to form mainly molten sodium sulfide. A portion of the fuel sulfur may also react with the molten salt to form sodium sulfate. Due to the presence of carbon in contact with the molten salt, sodium sulfate is continuously reduced to sodium sulfide through reactions (4) and (5). Some hydrogen sulfide may also form due to the reaction:

$$M_2S+H_2O=M_2O=M_2O+H_2S. \quad (7)$$

The hot gases rise from combustion region 112 up to drying region 110, thus keeping drying region 110 at an elevated temperature and contacting the sprayed slurry droplets to dry the slurry droplets.

Gas reaction products and other gas components including water vapor in reaction chamber 106 (generally referred to as off-gas) are discharged through gas outlet 136.

The off-gas contains CO and may also contain hydrogen. The high heating value of the off-gas may be about 290 Btu/scf (British thermal unit per standard cubic foot, on a dry basis). In some embodiments, and depending on the type of input fuel, oxidant gas, other materials used, and the conditions of operation, the off-gas may contain about 15 to about 70 v/v % (percentage by volume) of carbon monoxide. As used herein, all v/v % of gases are measured on a dry basis, i.e., excluding any water vapor content in the gas, unless otherwise indicated. In some embodiments, the off-gas may contain from about 20 to about 60 v/v % of carbon monoxide.

The hydrogen content in the off-gas may typically range from about 5 to about 40 v/v %. The hydrogen content in the off-gas may be lower when air is used as the oxidant gas, and may be higher when pure oxygen is used as the oxidant in combination with steam injection. For example, in the latter case, the hydrogen content in the off-gas may be up to 38%.

The impurities in the off-gas may include water vapor, hydrogen sulfide, salt fume particles, or other gas by-products. For some applications, the off-gas may be used without further treatment. In some applications, it may be cooled and purified to produce a dried and purified product gas, such as described herein. For example, $H_2S$ in the off-gas may be removed by absorption with an alkaline solution, such as in gas purifier 140 as illustrated below, or using an auxiliary gas purification system (not shown). The alkaline solution may be an aqueous solution originated from quench tank 146, or from another source.

If further treatment is desired, the off-gas may be transferred, through outlet 136, cooler-condenser 142, and conduit 144, to gas purifier 140. The pressure in gas purifier 140, and in conduit 144, is close to the pressure in gasifier 102. Cooler-condenser 142 cools the gases that pass through and reduces the water vapor content in the product gas. The condensed water is fed into quench tank 146 through conduit 154. It is possible that some or all of the off-gas flows out of gasifier 102 with the smelt stream through smelt outlet 138 and is discharged from quench tank 146 via conduit 152.

Solid and liquid reaction products, non-reacted particles, and other reaction residues fall into smelt region 114, which may be at a temperature from about 760 to about 1,200° C., such as from about 870 to about 980° C. Further reactions may occur in smelt region 114. Sulfur compounds in the fuel may react with carbonate salt and form additional sodium sulfide, and other sulfur compounds in smelt region 114. Thus, smelt region 114 typically contains various molten salts of the alkali metal, which in this example is sodium. The molten salts may include sodium carbonate, sodium bicarbonate, sodium sulfide, sodium thiosulfate, and other possible salts. Smelt region 114 may also contain ash and other reaction residues resulted from the combustion reactions. The major contents of molten salts 116, however, are sodium sulfide and sodium carbonate. A smelt effluent flows from reaction chamber 106 through smelt outlet 138 to quench tank 146.

The smelt effluent from reaction chamber 106 is quenched in quench tank 146, by mixing and cooling it with an aqueous medium. The aqueous medium may include cool or cold water. It is practical to keep the quench tank 146 pressure the same as that in gasifier 102. When gasifier 102 and quench tank 146 are appropriately positioned relative to each other, the smelt may flow under the force of gravity from reaction chamber 106 to quench tank 146.

All or a major portion of the aqueous medium may be condensed water received from conduits 154 and 156. The amount of the aqueous medium added to quench tank 146 may be adjusted to dissolve the smelt and produce an aqueous liquid that contains a desired total concentration of all dissolved solids. In one embodiment, the total concentration of all dissolved solid in the aqueous solution may be from about 5 to about 50 wt %.

The aqueous medium added to quench tank 146 may be sufficient to dissolve substantially all soluble constituents in the resulting aqueous liquid.

Water vapor and other vent gas released from the smelt and quench tank 146 are directed to conduit 152 into conduit 144 and fed into gas purifier 140, through cooler-condenser 142. Some of the vent gas and water vapor may be re-condensed and circulated back to quench tank 146. The vent gas in quench tank 146 may contain gasifier product gas that flows out of gasifier 102 with the smelt effluent.

The aqueous liquid exiting quench tank 146 contains sodium sulfide dissolved in water and other salts such as sodium carbonate.

The aqueous liquid exiting quench tank 146 is fed to gas purifier 140 through conduit 148 by pump 150. The aqueous liquid output from quench tank 146 may be highly alkaline with a pH typically in the range of 12 to 14. Its principal ingredients may include alkali metal sulfide and carbonate, but may also contain small amounts of other compounds such as alkali metal hydroxide, sulfate, and thiosulfate.

The pressure in gas purifier 140 may be about the same as or slightly lower than that of gasifier 102.

The alkaline aqueous liquid will come into contact with the gasifier off-gas received from conduit 144 and absorbs carbon dioxide and hydrogen sulfide contained in the gas phase. Carbon dioxide and hydrogen sulfide may be absorbed through, for example, the following reactions:

$$M_2CO_3+CO_2+H_2O=2MHCO_3, \quad (8)$$

$$M_2S+H_2O+CO_2=MHS+MHCO_3, \quad (9)$$

$$M_2S+H_2S=2MHS. \quad (9)$$

Because of such reactions, the carbonated solution output from gas purifier 140 contains alkali metal bicarbonate and bisulfide and is only mildly alkaline, with a pH in the range of about 7.5 to about 10.5. The absorption reactions may be carried to a point where the exiting aqueous solution may contain essentially no hydroxide or sulfide. The resulting solution, however, may contain a significant fraction of unreacted carbonate.

As a result, the carbon dioxide and hydrogen sulfide contents in the gasifier off-gas are reduced, and the final gas output from gas purifier 140 includes a high percentage of the desired combustible gases (i.e., CO and $H_2$). The gas output from gas purifier 140 may be directly used as a salable product, subject to optional further treatment, or used as an input for a downstream process. In addition to combustible gases, the product gas may also contain impurities such as those discussed above, mainly nitrogen, and carbon dioxide. The product gas may have a high heating value (HHV) of at least 100 Btu/scf dry basis (3.7 MJ/$Nm^3$), and as high as about 300 Btu/scf (11.2 MJ/$Nm^3$).

The liquid output from gas purifier 140 may contain water, alkali metal salts dissolved in water, and other substances such as ash and un-reacted fuel particles. The liquid output from gas purifier 140 is next fed to stripper 162 through pressure reduction valve 164. The pressure in stripper 162 is substantially lower than the pressure of gasifier 102. For example, the pressure in stripper 162 may be in the range from about 0.1 to about 2 atm, such as from about 0.2 to about 1.0 atm. Stripper 162 is also heated by heater 165. The heating fluid for heater 165 may be steam produced within the process, for example steam recovered in cooler-condenser 142, or from a different steam source.

The combined effect of reduced pressure, heat, and stripping vapor (i.e., water evaporation), promotes the following reactions:

$$MHS+MHCO_3=M_2CO_3+H_2S, \quad (11)$$

$$2MHCO_3=M_2CO_3+CO_2+H_2O. \quad (12)$$

The gas output from stripper 162 may include primarily acid gases, hydrogen sulfide and carbon dioxide, and water vapor. The output gas is removed through outlet 166, which is cooled by condenser 168. The acid gases may be transported to a downstream processing stage, such as a sulfur recovery plant (not shown). The condensed water in condenser 168 may be returned to stripper 162, through conduit 170, to be added to the aqueous liquid in stripper 162, or be fed to quench tank 146 through conduit 156 using pump 172.

The regenerated solution from stripper 162 may contain primarily water, alkali metal carbonate, such as sodium carbonate, and small amounts of other salts such as alkali metal sulfide, bisulfide, sulfate, bicarbonate, and thiosulfate. This liquid may have an alkalinity intermediate between the output stream from quench tank 146 and the carbonated solution output from gas purifier 140. For example, it may have a pH in the range of about 9 to about 13.

The solution output from stripper 162 may also contain other reaction residues such as ash. If so, the solution may be processed to remove the ash components in ash separator 174. The liquid may be transferred from stripper 162 to ash separator 174 through conduit 176 using pump 178. As depicted in FIG. 4 removal of the ash components is carried out after stripper 162. However, in different embodiments, separation of ash components from the liquid flow may be carried out at any suitable point in the liquid flow circuit. Separation of ash from the liquid may involve settling, filtration, centrifugation, or other suitable techniques for solid-liquid separation. Although a single ash separator 174 is depicted in FIG. 4, it should be understood that additional equipment or processing stages might be included in different embodiments for carrying out one or more of these separation procedures. The separated ash may be removed from the liquid flow through discharge outlet 180. The separated ash may contain silicon, aluminum, vanadium, or other compounds. The ash may be disposed or subject to further processing to recover by-products, such as vanadium.

In some applications, the combustion reactions in gasifier 102 may produce no or little ash. In such cases, it is not necessary to remove ash from the liquid flow circuit and ash separator 174 may be omitted.

It is also possible that some un-reacted fuel remains in the smelt effluent from gasifier 102. Such fuel residue may remain suspended in the liquid output from stripper 162. If present, such fuel residue may be removed from the liquid flow, such as with the ash components at separator 174, or be recycled back to slurry tank 120 with the aqueous liquid through conduit 130.

The regenerated aqueous solution from ash separator 174, or from stripper 162 if ash separation is not required, may be recycled to slurry tank 120 through conduit 130, and may be used as the main ingredient in the aqueous solution in slurry tank 120. Additional alkali metal carbonate, or water, or both water and carbonate may be added to the solution prior to entering slurry tank 120. Additional water or solute of carbonate may also be added separately to slurry tank 120, or added at some other point in the aqueous fluid circuit to adjust the concentration of dissolved salts in the slurry, or as make-up for water losses that may occur in system 100.

Additional water or carbonate may be added to adjust the concentration of carbonate salt in the slurry, or as make up for losses that may occur in system 100.

Conveniently, conduit 130 does not need to be heated or pressurized, although in some applications it may be heated or pressurized. The aqueous solution in conduit 130 may be at ambient temperature and near atmospheric pressure. As a result, corrosion in conduit 130 is less as compared to a heated conduit that contains molten salt of alkali metals.

It is not necessary to purify the aqueous solution in conduit 130 to the extent that it is substantially free of sulfide or bisulfide salts. The presence of sulfide or bisulfide salts in the aqueous solution, even at relatively high concentrations, is unlikely to cause sticking or plugging problems in the feeding system as the salts are fed as an aqueous solution. In comparison, significant quantities of sulfide or bisulfide salts present in a solid feed can cause sticking or plugging problems as solid sulfide or bisulfide salts tend to absorb water from the surrounding environment, such as air, and can swell and become sticky during transportation or feeding.

The exemplary processes described above may be modified in different embodiments.

For instance, in some embodiments, instead of feeding air through smelt region 114, which is below combustion region 112, pure oxygen and steam, as the oxidant, may be injected into spray region 108 of gasifier 102, which is above combustion region 112. A conduit for the off-gas output may be provided below combustion region 112, such as near the bottom of gasifier 102 just above the surface of the accumulated molten salts 116, to replace gas outlet 136, which is near the top of gasifier 102. For example, the off-gas in gasifier 102 may be allowed to flow out of gasifier 102 through smelt outlet 138 into quench tank 146, and then through gas conduits 152, 144 and into gas purifier 140. In such embodiments, the direction of the net gas flow and the net flow direction of the fuel in combustion region 112 are substantially the same (parallel-flow operation), both pointing substantially downwardly. In comparison, in the embodiment depicted in FIG. 2, the oxidant gas is fed into gasifier 102 below combustion region 112 and rises upward through combustion region 112, in a direction that is opposite to the net flow direction of the fuel in combustion region 112 (counter-flow operation). In a parallel flow operation, all or a portion of the water vapor required for reactions (2) and (3) may be provided by the water contained in the slurry fed into gasifier 102.

In some embodiments, it is not necessary to use the liquid from quench tank 146 to contact the off-gas from gasifier 102 in gas purifier 140. Instead, carbon dioxide from another source may be used to carbonate the aqueous solution. The off-gas may be purified in another gas purifier (not shown) or may be used without further purification.

A stream of pressurized steam may also be provided to be injected through spraying device 118, either with the slurry or separately, either continuously or intermittently. Injection of pressured stream through spraying device may be beneficial in some embodiments as it can prevent or clear possible build-up or clogging around the spraying nuzzles by the fuel particles or the salts.

An alternative carbonation process, such as the process disclosed in Rennick, may be used to regenerate the aqueous solution of the carbonate salt. In such an alternative process, precipitation of alkali metal bicarbonate crystals may occur, particularly when sodium salts are used. The solid salts may be subsequently re-dissolved, such as by heating to decompose the bicarbonate to form more soluble carbonates salt.

To prevent clogging of spraying device 118, and conduit 122, operation conditions may be selected so that the salts in the slurry will not be supersaturated for the given temperature and pressure. The spraying device and the slurry conduit may also be periodically cleaned using for example steam.

In some embodiments of the present invention, the final product gas may be essentially free of sulfur. In some applications, approximately 90 to 99% of feed sulfur may be recovered in the regeneration process. This level of removal would be generally adequate to meet environmental requirements for combustion use of product gas. However, in some applications, such as when the product gas is to be used in synthesis of chemicals, further sulfur removal may be required, such as to prevent poisoning the catalyst.

In most embodiments of the present invention, the amounts of by-products such as tar, heavy hydrocarbons and NOx formed in the gasification and regeneration processes are negligible. The catalytic effect of the smelt may cause near complete destruction of heavy hydrocarbons and organic nitrogen compounds at the gasifier operating temperature.

Valuable byproducts such as sulfur and vanadium may be recovered relatively easily in some embodiments of the present invention. In most applications, all ash constituents will be contained in the smelt, which may be processed in the salt regeneration stage to remove ash components, and, to recover vanadium.

In some embodiments of the present invention, thermal efficiency is high. Although actual efficiency is a function of fuel composition and other design parameters, a relatively high efficiency may be achieved in some embodiments because no char is produced and carbon utilization is generally over 98%. Heat losses may also be low because the combustion region does not need to be actively cooled in most embodiments. The product gas may also be amenable to efficient heat recovery because it may be at a moderate temperature and may be relatively free of tar, ash and other objectionable impurities.

In an embodiment such as the one shown in FIG. 4, many materials such as alkali metal and water may be recycled, and outputs from different stages of the process may be efficiently used at another stage of the process, thus efficient utilization of raw materials and resources may be achieved. Consumption of certain raw materials and resources may be reduced or minimized.

Premature caking or swelling of the fuel can be conveniently prevented because fuel particles are being fed as a low temperature slurry and as the slurry is sprayed into the gasifier, the particles are dispersed and wetted with the salt solution.

While the fuel particles may need to be less than a certain size, such as less than about 4 or 8 mesh, depending upon the fuel type, the specific application, and the given system capacity, in order to be conveyable in a slurry or aqueous mixture, the fuel particles do not have to be closely sized. Pulverization and fines removal may be unnecessary in some embodiments of the present invention.

The demand for oxygen may be relatively low in some embodiments of the present invention. If a typical petroleum coke is used as the input fuel, about 0.8 kg of oxygen may be sufficient for converting 1 kg of input petroleum coke.

Conveniently, when the oxidant gas is fed through the smelt region, the risk of explosion is lowered because if there is a stoppage of input fuel and thus a lack of carbon, excess oxygen can be absorbed by an inventory of reduced compounds in the smelt region, such as sodium sulfide, and residual carbon.

In some embodiments of the present invention, where a molten salt pool is maintained in the gasifier, the gasifier turndown capability is excellent because a gas-sparged molten pool is relatively insensitive to gas velocity. In contrast, entrained flow and fluidized bed gasifiers require a minimum gas flow rate to maintain stable operation.

Embodiments of the present invention are further illustrated in the following examples.

Examples

Table 1 lists a typical composition of a petroleum coke. Tables 2 and 3 list predicted input and output balance calculated based on the test results described in Kohl and Ashworth, using a computer model for gasification processes. The calculations are based on 100 grams of dry coke feed.

For the calculations, the following is assumed:

The petroleum coke is mixed with an equal weight of an aqueous solution containing approximately 18% sodium carbonate and 2% sodium bisulfide. The resulting slurry is fed into a gasifier operating at a pressure of 20 atmospheres (294 psia) and a temperature of about 1,000° C. in the combustion (gasification) zone.

Molten smelt flows from the gasifier into a quench tank operating at the same pressure as the gasifier and is dissolved in approximately 80 grams of water to yield about 98.7 grams of quench solution.

The quench solution is regenerated by carbonating it in an absorber used to scrub the gasifier off-gas then stripping $H_2S$ and $CO_2$ from it in a sub-atmospheric pressure stripper. The stripper produces an acid gas stream containing approximately 50% $H_2S$ and 50% $CO_2$ by volume, dry basis.

Ash is removed from the regenerated solution by filtration and the filter cake is washed with water to remove soluble salts.

The filtered regenerated solution is recycled, to the slurry preparation step.

The approximate material balance around the gasifier is given in Table 2.

The material balance around the quench tank and solution regeneration system is given in Table 3. The material balance envelope for this table includes all steps relating to solution processing including smelt dissolution; product gas cooling, water condensation, and scrubbing; solution stripping; acid gas cooling and water condensation, and ash separation.

Table 3 also presents the approximate composition of the product and byproduct gas streams.

Calculation shows that the product gas has a high heating value (HHV) of about 124 Btu/scf (4.6 MJ/Nm3), dry basis, which is suitable for fuel to a gas turbine.

The material balances shown in Tables 2 and 3 are approximate and include only the principal components in each input or output stream.

In practice, a small amount of alkali metal salt may be present in the ash filter cake, and minor amounts of oxidized sulfur compounds such as sulfate and thiosulfate may be present in the smelt taken from the gasifier and in the aqueous solutions. In addition, traces of higher hydrocarbons and other sulfur compounds may be present in the product gas stream.

Although certain embodiments of the techniques of the present application have been described, the spirit and scope of the application is by no means restricted to what is described above. Persons having ordinary skill in the art will be able to make variations, permutations, and combinations, in view of the above description, all of which are within the scope of the present application.

TABLE 1

| Test Fuel (Petroleum Coke) Composition | |
|---|---|
| Component | Concentration (wt %, dry basis) |
| Carbon | 88.9 |
| Hydrogen | 3.9 |
| Nitrogen | 2.2 |
| Sulfur | 2.1 |
| Oxygen | 1.3 |
| Ash | 1.6 |
| Total | 100 |

TABLE 2

| Gasifier Material Balance | | | | | | |
|---|---|---|---|---|---|---|
| | INPUT (weight in grams) | | | | OUTPUT (weight in grams) | |
| Feed Slurry | Solid Phase | Carbon | 88.9 | Off-gas | CO | 185.1 |
| | | Hydrogen | 3.9 | | $CO_2$ | 35.8 |
| | | Nitrogen | 2.2 | | $H_2$ | 4.8 |
| | | Sulfur | 2.1 | | $N_2$ | 403.4 |
| | | Oxygen | 1.3 | | $CH_4$ | 1.2 |
| | | Ash | 1.6 | | $H_2O$ | 71.9 |
| | Aqueous Phase | $Na_2CO_3$ | 18.0 | | $H_2S$ | 0.1 |
| | | NaHS | 2.0 | Smelt | $Na_2S$ | 7.7 |
| | | $H_2O$ | 80.0 | | $Na_2CO_3$ | 9.4 |
| Compressed Air | Oxygen | | 119.8 | | Ash | 1.6 |
| | Nitrogen | | 401.8 | | | |
| | Total Input | | 721.0 | Total Output | | 721.0 |

TABLE 3

| Input and Output Mass Balance for Quench Tank and Solution Regeneration System | | | | |
|---|---|---|---|---|
| Input | | Output | | |
| | Weight (g) | | Weight (g) | v/v % |
| Off-gas | | Purified Gas | | |
| CO | 185.1 | CO | 185.1 | 27.1 |
| $CO_2$ | 35.8 | $CO_2$ | 29.3 | 2.7 |
| $H_2$ | 4.8 | $H_2$ | 4.8 | 9.8 |
| $N_2$ | 403.4 | $N_2$ | 403.4 | 59.1 |
| $CH_4$ | 1.2 | $CH_4$ | 1.2 | 0.3 |
| $H_2O$ | 71.9 | $H_2O$ | 4.3 | 1.0 |
| $H_2S$ | 0.1 | $H_2S$ | negligible | 0.0 |
| Smelt | | Acid Gas | | |
| $Na_2S$ | 7.7 | $H_2S$ | 2.2 | 50 |
| $Na_2CO_3$ | 9.4 | $CO_2$ | 2.9 | 50 |
| Ash | 1.6 | Regenerated Solution | | |
| Make-up Water | | $Na_2CO_3$ | 18.0 | |
| $H_2O$ | 15.4 | NaHS | 2.0 | |
| | | $H_2O$ | 80.0 | |
| | | Ash Cake | | |
| | | Ash | 1.6 | |
| | | $H_2O$ | 1.6 | |
| Total Input | 736.4 | Total Output | 736.4 | |

What is claimed is:

1. A process of producing a combustible gas from a solid sulfur-containing carbonaceous fuel, comprising:

providing a first aqueous solution, a solute thereof being a carbonate salt of an alkali metal;

mixing particles of said solid sulfur-containing carbonaceous fuel and said first aqueous solution to form a slurry;

pumping and feeding said slurry into a gasifier, wherein said feeding being through a spray system forming a spray of said slurry, said spray comprising of a number of flowing droplets to accommodate rapid drying of said slurry;

feeding pressurized oxidant gas into said the gasifier;

said gasifier having an upper drying zone whereby water evaporates out of said flowing droplets of aqueous slurry forming at least partially dried droplets comprising of said fuel and said salt of alkali metals;

a lower gasification zone whereby said salt is melted to form smelt and said fuel is gasified by reaction with said oxidant aided by catalytic effect of said salts at a temperature in the range of about 900° C. to 1150° C. to produce a gasifier off-gas, containing carbon monoxide and water vapor, and a hot liquid smelt containing molten alkali metal sulfide;

said gasification zone incorporating a pool of liquid smelt, whereby molten salt droplets and non-gasified particles of fuel land and further gasify inside said pool;

recovering said gasifier off-gas as said combustible product gas;

recovering said first aqueous solution by draining said smelt into a quench tank operating at essentially the same pressure as the gasifier;

quenching and dissolving said smelt in an aqueous medium to form a second aqueous solution;

contacting said second aqueous solution with a carbon dioxide-containing gas, depressurizing, heating, and stripping hydrogen sulfur from said aqueous liquid, to form said first aqueous solution comprising said solute of alkali metal carbonate salt; and utilizing the depressurized and regenerated first solution as the principal fluid to make said slurry.

2. The process of claim 1, comprising removing an ash component from said second aqueous solution.

3. The process of claim 1, wherein at least a portion of said carbon dioxide gas is produced in said gasifier.

4. The process of claim 1, wherein said slurry comprises about 25 to about 75 wt % of said fuel.

5. The process of claim 1, wherein said slurry is at a temperature below about 200° C. prior to entering said gasifier.

6. The process of claim 1, wherein said gasifier has an internal gas pressure higher than about 4 atm.

7. The process of claim 1, wherein said oxidant gas is selected from air, oxygen-enriched air, and substantially pure oxygen.

8. The process of claim 1, comprising feeding steam into said gasifier.

9. The process of claim 1, wherein said second aqueous solution comprises about 5 to about 50 wt % of said carbonate salt.

10. The process of claim 1, comprising removing said product gas from said gasifier and purifying said product gas, said product gas after said purification being substantially free of sulfur and having a high heating value higher than about 100 Btu/scf on a dry basis.

11. The process of claim 1, wherein said alkali metal comprises one or both of sodium and potassium.

12. The process of claim 1, wherein said fuel is petroleum coke.

13. The process of claim 1, wherein said gasifier comprises a plurality of gasifiers.

* * * * *